United States Patent [19]

Elliesen

[11] Patent Number: 4,667,572

[45] Date of Patent: May 26, 1987

[54] VALVE ARRANGEMENT

[75] Inventor: Wolfgang Elliesen, Ahrensburg, Fed. Rep. of Germany

[73] Assignee: Joh. Friedrich Behrens AG, Fed. Rep. of Germany

[21] Appl. No.: 776,675

[22] Filed: Sep. 16, 1985

[30] Foreign Application Priority Data

Jun. 21, 1985 [EP] European Pat. Off. ..... 85107700.8

[51] Int. Cl.[4] ..... F15B 13/042

[52] U.S. Cl. ..... 91/461; 91/454; 137/596.14; 227/130

[58] Field of Search ..... 137/596.14, 596.16, 137/596.15; 91/454, 457, 25, 461; 227/130

[56] References Cited

U.S. PATENT DOCUMENTS

| | | | |
|---|---|---|---|
| 2,960,067 | 11/1960 | Osborne | 91/461 X |
| 3,170,487 | 2/1965 | Juilfs et al. | 137/625.6 |
| 3,278,105 | 10/1966 | Juilfs et al. | 277/130 |
| 3,392,632 | 7/1968 | Volkmann | 91/461 X |
| 3,871,566 | 3/1975 | Elliesen et al. | 227/130 |
| 4,117,767 | 10/1978 | Elliesen | 227/130 X |
| 4,401,251 | 8/1983 | Nikolich | 277/130 |
| 4,509,669 | 4/1985 | Elliesen | 227/130 |

FOREIGN PATENT DOCUMENTS 2601836 6/1981 Fed. Rep. of Germany .

*Primary Examiner*—Gerald A. Michalsky
*Attorney, Agent, or Firm*—Vidas & Arrett

[57] ABSTRACT

A valve arrangement for a compressed-air operated nailing apparatus with valve pistons operating without intersection in such a manner that the one valve piston cooperates with the working cylinder and is guided by the other working piston which is controlled by an auxiliary control valve, wherein the first auxiliary piston is also controlled at the same time, and wherein upon opening the valve arrangement the second valve piston is moved first into the opening position and the first valve pistion thereafter.

9 Claims, 4 Drawing Figures

VALVE ARRANGEMENT

The invention relates to a valve arrangement for a pressurized-air operated nailing apparatus, comprising a valve piston (closing member for the inlet and outlet valve of the power stroke chamber), said piston being guided above the working cylinder coaxially therewith for axial displacement and blocking in its lower position (closing position) the power stroke chamber vis-à-vis the compressed-air supply as well as blocking in its upper position (opening position) an outlet passage which is communicating with the power stroke chamber via a bore of the valve piston and has a lower effective surface constantly biased by the pressure from the source of compressed air, and a larger upper effective surface adapted to be selectively exposed to the atmospheric pressure or the pressure of the source of compressed air with the aid of a pilot valve, a sleeve-shaped valve seat element which is sealingly guided for longitudinal displacement in a bore and is limited in its movement by an upper and a lower abutment, the bore of which being in communication with the bore of the valve piston and which has a first effective surface facing away from the valve piston and a second effective surface facing the valve piston, with the last mentioned effective surface being the larger one and the valve piston when in the upper position (opening position) coming to lie in sealing engagement against the second effective surface of the valve seat element in its position at the upper abutment and with the valve piston in its lower position (closing position), on the other hand, being spaced through a distance from the second effective surface of the valve seat element in its position at the lower abutment.

Such a valve arrangement is known (German patent letter No. 2 601 836). When the valve piston is disposed in its opening position and its upper effective surface is again biased with pressure to move it into the closing position, then the sleeve-shaped valve element will follow the valve piston and will remain in sealing engagement therewith, so that the outlet passage remains furthermore closed. Thereby, compressed air is prevented from flowing directly to the outlet channel from the reservoir, as long as the valve piston is not yet disposed in its closing position. If no special arrangement were made, compressed air flowing into the power stroke chamber would momentarily escape via the outlet as before, until it is shut off in the upper position of the valve piston. In this connection, provision is made in the known valve arrangement for a special sealing at the valve piston which, during the opening movement of the valve piston carries the working piston along with it in an upward direction, until the valve piston reaches its closing position. In this manner, a valve arrangement is obtained which is free of intersection, i.e. no pressurized air is lost during the actuation of the control valve. However, the sealing at the valve piston as mentioned adds considerably to the cost and has to be considered to be a member subjected to wear.

A valve arrangement working free of intersection has also become known in which the valve piston consists of two valve members relatively movable with respect to each other (U.S. Pat. No. 4,401,251). The first valve member has an upper and a lower plate. The upper plate is sealingly guided in a recess formed in the housing with the upper effective surface thereof being selectively biased with the atmospheric pressure or the pressure of the source of compressed air. The lower plate has an upper circumferentially extending sealing surface. The second valve member is arranged between the upper and the lower plate. Its upper portion is sealingly guided in a recess of the upper plate of the first valve member. Its lower portion surrounds the lower plate of the first valve member and sealingly cooperates with the working cylinder. In the position of rest there exists a space between the upper sealing surface as mentioned of the lower plate of the first valve member and the lower portion of the second valve member. If, by virtue of the venting of the upper effective surface of the first valve member the latter is moved into the opening position, the lower plate of the first valve member will after a certain distance take the second valve member along with it and will thus release the connection between the power stroke chamber and the compressed-air reservoir. Owing to the second valve member being taken along by the first one a sealing engagement also will take place between these two thereby blocking the outlet. This known valve arrangement suffers from some drawbacks.

The structure of the first valve member makes it a prerequisite that the latter be formed of at least two separate structural members. With the known valve arrangement they are made separately and screwed together. During the opening step the lower plate of the first valve member thrusts against the second valve member. Thereby, quite a substantial meachanical stress is effected. As this stress will occur in the sealing area, the danger exists that the sealing effect might be impaired after a certain period of time. During the closing step the working cylinder moves upward towards the second valve member. Owing thereto, a space may form with respect to the second valve member during the downward movement of the first valve member so that upon the return stroke the air may escape out of the cylinder. A displaceable support of the working cylinder necessitates additional expense.

It is the object of the invention to provide a valve arrangement for a compressed-air operated nailing apparatus working free from intersection and which is of an especially simple design and works with little wear.

According to the invention this object is attained in that the valve piston comprises a first piston member comprising the bore as well as the upper and the lower effective surface and cooperating with the valve seat element, with an annular second piston member supported to be axially and sealingly displaced in an annular recess formed in the first piston member which faces the power stroke chamber, an effective surface of the second piston member which faces away from the power stroke chamber being in communication with the upper effective surface of the first piston member via at least one bore, while a lower effective surface of the second piston member sealingly cooperates with the working cylinder and in the lower position (closing position) is constantly biased by the pressure of the source of compressed air, and the ratio of the effective surfaces of both piston members being such that in case of a decrease of pressure at the upper effective surface of the first piston member the first piston member will be adjusted first into the upper position and, with a lower pressure value, the second piston member will then be adjusted into the upper position.

With the valve arrangement according to the invention, both piston members are simple disc-shaped and annular constructional members, respectively, which may be inserted into the housing from above one after the other in a simple manner. The annular piston inserted into an annular recess of the first piston member cooperates with the working cylinder. It projects slightly above the cylinder so that it is constantly biased with the pressure of the reservoir. Also the first piston member is constantly biased with the pressure of the compressed-air reservoir from below. The upper effective surface of the annular piston is biased with the same pressure that prevails in the chamber above the first piston member via one or several bores. This chamber is selectively biased with atmospheric pressure or the pressure of the source of compressed air in a manner known per se with the aid of a pilot valve. In case of pressure bias, this pressure applied to the upper effective surfaces of the two piston members suffices to keep both piston members in the lower position of closing. It the upper chamber is vented, the difference in pressure at the two piston members leads to a reversal of the direction of effectiveness.

The effective surfaces, however, are designed to be such that with the first value of difference in pressure the first piston member will move into the upper opening position. With this movement it comes to lie in close contact against the valve seat element and thereby closes the outlet. During this period of time the second piston member remains in sealing engagement with the working cylinder. Only with a second difference in pressure will it likewise lift off from the working cylinder in order to move into its upper opening position. The air now flowing into the power stroke chamber, therefore, can no longer escape via the outlet.

If the pressure chamber above the upper effective surface of the first piston member is again biased with compressed air, the two piston members will move downward in common into the closing position. On the ground of the difference in pressure prevailing at the valve seat element, the valve seat element, too, will follow this movement. Thereby, the outlet remains closed, until the valve seat element abuts against the lower abutment. As the piston members are moving further downward a certain distance, the outlet is now opened, and the air present in the cylinder may be expelled into the open during the return stroke of the working piston.

The valve arrangement according to the invention is not only of an especially simple construction but also works with extremely little wear. There is no heavy stress exerted on polymeric sealing elements. Also the mechanical stress exerted on the valve members is extremely low.

Advantageous further developments of the invention are indicated in the subclaims.

The invention will be described in the following in more detail by way of drawings.

Figure 1:
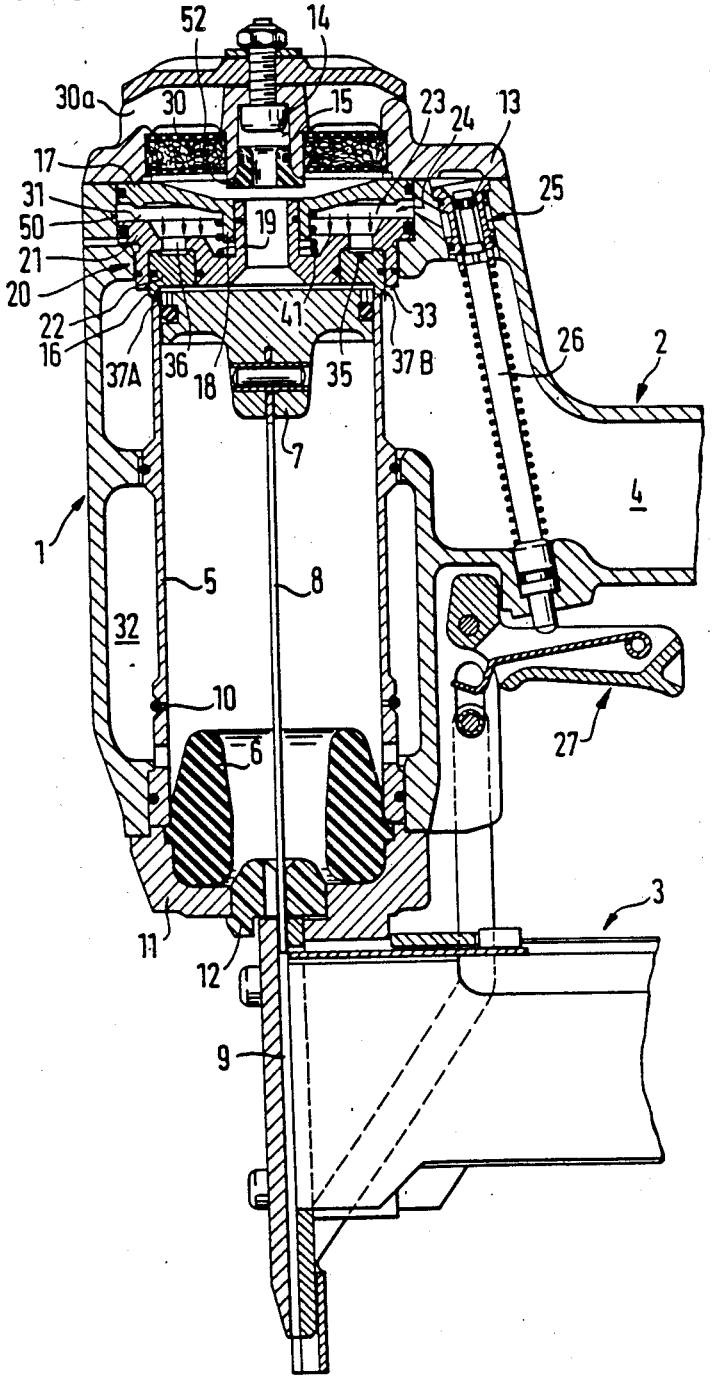
FIG. 1 shows a sectional view of a compressed-air operated nailing apparatus with a valve arrangement according to the invention in the position of rest.

Prior to enlarging in more detail on the individual representations shown in the drawings, it has to be stated that each of the features described is of inventively essential importance by itself or in connection with features of the claims.

The compressed-air operated nailing apparatus (tacker) shown in FIG. 1 consists of a housing portion 1, a handle portion 2 and a magazine portion 3. An inner space 4 of the handle portion 2 constitutes a compressed air reservoir for the accommodation and provision of compressed air. Disposed in the housing 1 is a working cylinder 5. A braking ring 6 is arranged at the lower end of the cylinder 5 which limits the stroke of the working piston 7 and dissipates kinetic energy not consumed in the operation of driving a fastening means. Fastened at the piston 7 is a drive-in plunger 8 which is guided in an axial prolongation in the shooting canal 9. The cylinder 5 is coaxially surrounded in the lower half thereof by a free space 32 which in the lower position of the working cylinder 7 is filled with compressed air through bores 10 provided in the cylinder 5 said compressed air being used to return the working piston 7. The lower space of the housing 1 is sealed at the bottom 11 by a stopper-like element 12 of polyurethane which at the same time serves as a guide for the drive-in plunger 8.

At the upper end thereof the housing 1 is closed by a cap 13. The central portion of the cap 13 is provided with a blind bore 14 for the accommodation and guidance of a valve seat element 15. Arranged coaxially about the central portion of the cap 13 is a wire filter 30 to silence the sound of air exiting via the outlet channel 30A.

Between the cap 13 and the upper end face 16 of the cylinder 5 an intermediate member 17 is sealingly inserted in a cylindrical recess 50 of the housing 1. It comprises a sleeve-like extension 18. A master valve 20 comprises a first valve piston 21 which is sealingly guided in the recess 50 below the intermediate member 17. The disc-like piston member 21 is provided with a lower effective surface 33 which is constantly biased with the pressure in the compressed-air reservoir 4. An annular piston 22 is arranged in a downward opening annular recess of the first piston member 21 and is adapted to be sealingly and slidably displaced therein. The end face of the annular piston 22 facing the working cylinder comprises two sections of effective surface. An internal section of effective surface 37A sealingly cooperates with the end face 16 of cylinder 5. A section of effective surface 37B of the annular piston 22 which is disposed radially further to the outside is formed by the portion of the annular piston 22 projecting above the cylinder 5 which is biased with the pressure in the reservoir 4. The annular piston 22 thus is limited in its axial movement in an upward sense by the valve piston 21. In a downward sense the annular piston 22 is completely freely movable with respect to the valve piston 21. Its downward movement is, however, limited by the working cylinder.

The first piston member 21 comprises a sleeve-shaped neck 19 sealingly and slidably cooperating with the sleeve-shaped prolongation 18 of the intermediate member 17. Arranged on the prolongation 18 is a compression spring 41 which cooperates with the upper surface of the disc-shaped piston member 21 constantly attempting to press the latter downward.

Formed between the intermediate member 17 and the first piston member 21 is a control chamber 23 communicating via a bore 24 with a pilot valve 25 which comprises a valve rod 26 actuated by a release lever 27. The design of the pilot valve 25 is not explained in any more detail because it is generally known. Upon actuation of the release lever 27 the valve rod 26 is adjusted in an upward sense whereby the control chamber 23 is connected to the atmosphere. In the position as shown in FIG. 1 the pressure of the reservoir 4 prevails in the control chamber 23, as indicated by several arrows.

The upper piston member 21 is provided with several throughbores 36. The annular piston 22 has an annular groove 35 in the upper effective surface thereof. In this manner, the pressure of the control chamber 23 likewise prevails at the upper effective surface of the annular piston 22.

As will be noted, the sleeve-shaped valve seat element 15 has a lower radial flange 52 which limits the movement of the valve seat element 15 in an upward sense into the bore 14. In this manner, the lower effective surface of the valve seat element 15 also becomes greater than the upper one.

The mode of operation of the valve arrangement as shown is as follows:

In the position of rest of the compressed-air operated nailing apparatus as shown in FIG. 1 the release lever 27 is not actuated. The valve rod 26 is disposed in a lower position. Owing thereto, compressed air may enter the control chamber 23 from the reservoir via the bore 24. In the control chamber 23 the upper effective surface 31 of the piston member 21 is biased with compressed air. The downwardly directed effective energy is reduced by the upwardly directed effective energy which is created by the bias on the annular surface 33. In the same manner, the annular piston 22 is biased downwardly with a greater effective force into sealing engagement with the cylinder 5.

If the release lever 27 is actuated, the valve rod 26 is lifted. The compressed air from the reservoir 4, now, can no longer arrive in the control chamber 23 via the bore 24, rather, the control chamber 23 is connected to the atmosphere. Thereby, a decrease in pressure takes place in the control chamber 23. As soon as the pressure in the control chamber is low enough the pressure on the effective surfaces 33, 37B will prevail, in order to bring these members into the opening position.

Figure 2:
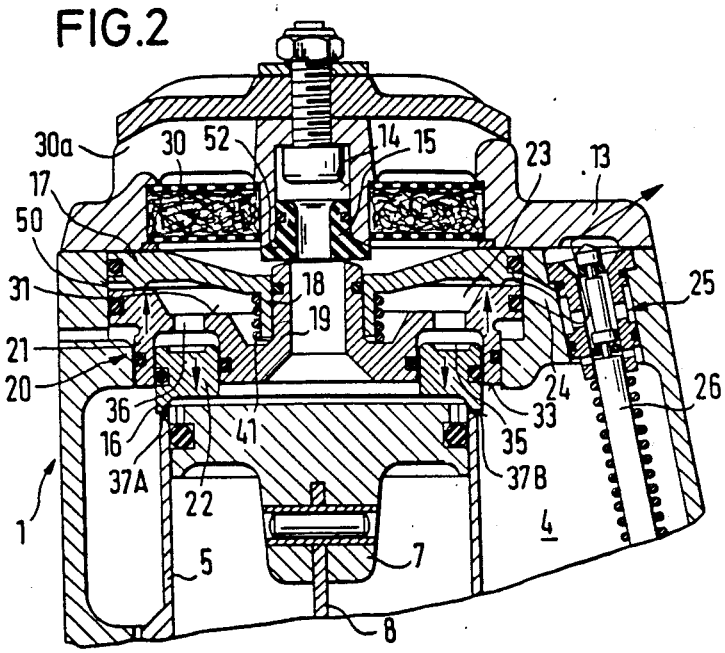
FIG. 2 shows a representation of the valve arrangement according to FIG. 1 on an enlarged scale during a first opening phase.
Figure 3:
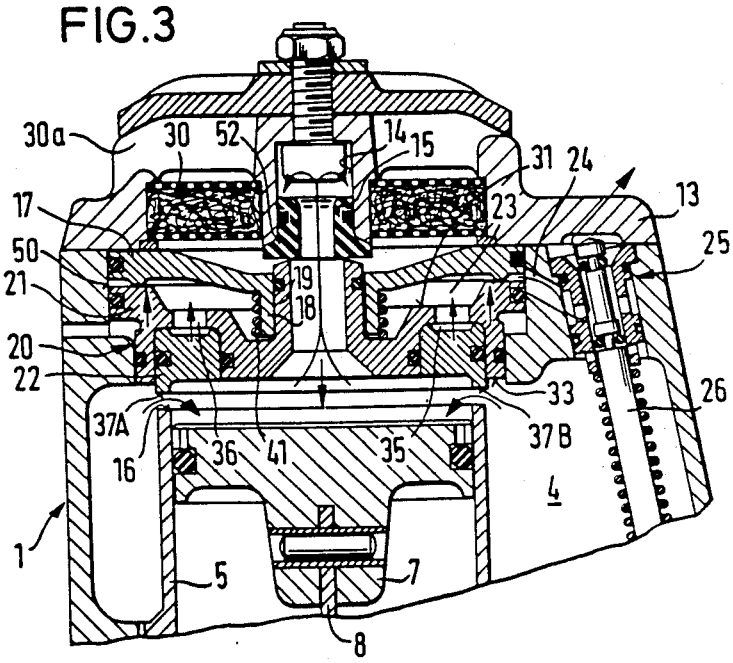
FIG. 3 shows the valve arrangement according to FIG. 2 in the opening position.

The ratio of the effective surfaces mentioned, however, is such that with a decrease in pressure in the control chamber 23 the disc-shaped piston member 21 will first move upwards until the neck 19 thereof comes to lie against the valve seat element 15 thus closing the outlet channel 30A. Only after a further decrease in pressure in the control chamber 23 will the annular piston 22, too, move into the opening position by virtue of the pressure at the section of effective surface 37B now coming to prevail, so that now compressed air may enter the power stroke chamber from the reservoir 4. FIG. 2 shows the opening phase in which the annular piston 22 is still in engagement with the cylinder 4, but the first piston member 21 is already in sealing engagement with the valve seat element 15. In FIG. 3 both valve members 21, 22 are shown in the opening position, and the working piston 7 is at the beginning of its working stroke.

Figure 4:
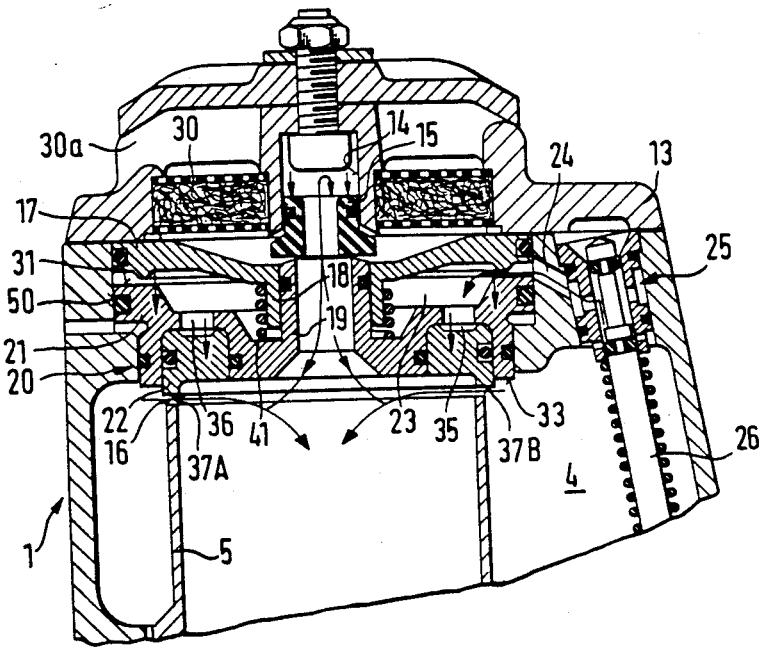
FIG. 4 shows the valve arrangement according to FIGS. 2 and 3 during the closing phase.

In FIG. 4, the piston 7 is at the end of its working stroke (not shown). In this position, the space 32 is filled with compressed air via the bores 10 formed in the cylinder 5. This compressed air is made use of for the return of the working piston 7 into its starting position. In the position shown in FIG. 4 the valve rod 26 has already assumed its lower position again which takes place automatically, as soon as the release lever 27 is released. Thereby the connection between the compressed-air reservoir 4 and the chamber 23 is established again. FIG. 4 shows the entry of compressed air into the control chamber 23 just before the closing movement of the master valve. The valve members 21, 22 are adjusted back into the closing position, as soon as the pressure in the control chamber 23 has sufficiently increased. As soon as this pressure together with the force of the spring 41 overcomes the upward acting force, both valve members will move downwards. The valve seat element 15 also follows the movement of of the valve member 21, so that the outlet 30A remains furthermore shut. A separation of the valve seat element 15 and the neck of the valve member 21 takes place only after the valve seat element 15 has struck against the intermediate member 17. Thereby, the the force relationships at the valve seat element 15 become inverted, and it will be forced back into the upper position (according to FIGS. 1 to 3) by the compressed air present in the cylinder chamber. With this, the outlet is opened, and the working piston 7 may force the compressed air out of the cylinder. The cylinder arrives back in the starting position as shown in FIG. 1 with the aid of the compressed air stored in chamber 32. With this, one working cycle is terminated.

I claim:

1. An apparatus for stapling purposes comprising a working cylinder (5), having an upper free end (16) thereof defining a cylinder valve seat, a working piston (7) slidably received in said working cylinder for actuating a driving blade, a reservoir (4) adapted to be connected to a source of pressurized air, an exhaust passage **(30*a*), valve means between said cylinder valve seat and said exhaust passage, said valve means including a first piston member (21) having a throughbore (30) and a lower effective surface (33) and an upper effective surface (31), said lower effective surface (33) facing said cylinder valve seat and being continuously in fluid connection with said reservoir (4), said upper effective surface (3) being in fluid communication with a control chamber (23), a pilot valve (25) in fluid communication with said control chamber, said pilot valve connecting said control chamber to said reservoir in a deactivated position and said pilot valve connecting said control chamber to atmosphere in an actuated position, said first piston (21) having an annular recess in the lower effective surface (33) thereof facing said cylinder valve seat, said first piston defining at least one bore extending therethrough between an upper effective surface of a second piston and said control chamber, said first piston annular recess further sealingly receiving an annular second piston member (22), said second piston member (22) having an upper effective surface and a lower effective surface, said lower effective surface (37*a*) cooperating with said cylinder valve seat and extending radially beyond said cylinder valve seat to define a second lower effective surface (37*b*), said valve means further including a sleeve-like valve seat member (15) slidably received in a bore (14) of a blind cup, said valve seat member (15) having an extreme upper and lower position limited by upper and lower abutment means, said valve seat member (15) having an upper and a lower effective surface and a throughbore, said first piston (21) having an upper extension (19) defining a first piston valve seat for cooperation with the lower effective surface of said valve seat member (15) said upper extension having a central bore, said throughbore being aligned to said central bore, the ratio of the areas of the lower effective surface to the upper effective surface of said first piston member (21) being such that said first piston member (21) moves upwardly toward valve seat member (15) when said control chamber (23) is connected to atmosphere by said pilot valve and said first piston member moves downwardly toward said working piston when said pilot valve connects the pressure within said reservoir to said control chamber (23), the ratio of said upper effective surface of said second piston member and said second lower effective surface (37***b*) of said second piston member (22) being such that said second piston member (22) remains engaged with said cylinder valve seat until said extension (19) of said first piston member (21) engages said valve seat member lower effective surface which closes said exhaust passage (30*a*), the ratio of the upper effective surface to the lower effective surface of said valve seat member (15) being such that said valve seat member (15) follows said extension (19) when said first valve piston member (21) moves downwardly towards said working cylinder until said valve seat member (15) engages a lower abutment means (17), said lower abutment means being rigidly connected to an exterior housing of said apparatus, said lower abutment means (17) being constructed and arranged such that said second piston member (22) engages said cylinder valve seat before said valve seat member (15) engages said lower abutment means (17) such that said exhaust passage (30*a*) remains closed until said working cylinder (5) is no longer in fluid communication with said reservoir (4).

2. A valve arrangement according to claim 1, characterized in that the second piston member (22) is limited in its upward movement by the first piston member (21) and in its downward movement by the upper end of the cylinder (5).

3. A valve arrangement according to claim 2, characterized in that an annular groove (35) is formed in the upper effective surface of the second piston member (22).

4. A valve arrangement according to claim 3, characterized in that said upper extension (19) of the first piston member (21) which defines the central bore is slidably and sealingly guided in a sleeve-like extension (18) of said lower abutment means.

5. A valve arrangement according to claim 2, characterized in that said upper extension (19) of the first piston member (21) which defines the central bore is slidably and sealingly guided in a sleeve-like extension (18) of said lower abutment means.

6. The valve arrangement according to claim 1 characterized in that an annular groove (35) is formed in the upper effective surface of the second piston member (22).

7. A valve arrangement according to claim 6, characterized in that said upper extension (19) of the first piston member (21) which defines the central bore is slidably and sealingly guided in a sleeve-like extension (18) of said lower abutment means.

8. The valve arrangement according to claim 1, characterized in that said upper extension (19) of the first piston member (21) which defines the central bore is slidably and sealingly guided in a sleeve-like extension (18) of said lower abutment means.

9. A valve arrangement according to claim 8, characterized in that said lower abutment means includes a separate covering element (17) which is sealingly inserted in a cylindrical recess of the housing (1), movement of said covering element being limited by a lid and by a compression spring (41) arranged between the covering element (17) and the first piston member (21).

* * * * *